US005309581A

United States Patent [19]

Lockwood et al.

[11] Patent Number: 5,309,581

[45] Date of Patent: May 10, 1994

[54] WATER STEAM APPARATUS

[76] Inventors: Arthur D. Lockwood, 5428 Davit, Santa Ana, Calif. 92704; Robert G. Lockwood, 13660 Ocana Ave., Bellflower, Calif. 90706

[21] Appl. No.: 151,939

[22] Filed: Nov. 15, 1993

Related U.S. Application Data

[63] Continuation of Ser. No. 977,089, Nov. 16, 1992.

[51] Int. Cl.[5] ..... E04H 4/00; A47K 3/04

[52] U.S. Cl. ..... 4/507; 4/591; 239/590.3; 239/590.5; 239/597

[58] Field of Search ..... 4/492, 496, 507, 508, 4/509, 591, 678; 239/590.3, 590.5, 597

[56] References Cited

U.S. PATENT DOCUMENTS

| | | | |
|---|---|---|---|
| 2,147,925 | 2/1939 | Schwalbe | 239/597 X |
| 3,829,911 | 8/1974 | Bishop | 4/509 X |
| 3,831,852 | 8/1974 | Stillman, Jr. | 4/507 X |
| 4,334,328 | 6/1982 | Delepine | 4/678 |
| 4,412,654 | 11/1983 | Yates et al. | 239/597 X |
| 4,502,304 | 3/1985 | Hopkins | 239/590.3 X |
| 4,513,458 | 4/1985 | Delepine | 4/661 X |
| 4,881,280 | 11/1989 | Lesikar | 4/591 X |
| 5,115,974 | 5/1992 | Tobias et al. | 4/492 X |
| 5,127,111 | 7/1992 | Sieth | 4/591 |

FOREIGN PATENT DOCUMENTS

| | | | |
|---|---|---|---|
| 0275084 | 9/1988 | European Pat. Off. | 4/678 |

*Primary Examiner*—Robert M. Fetsuga
*Attorney, Agent, or Firm*—Edward E. Roberts

[57] ABSTRACT

Apparatus for producing a waterfall at the edge of a swimming pool, spa or pond, the apparatus including a generally cylindrical reservoir in the water circulation system path, with at least one water discharge metering rod on the axial centerline of the reservoir, configured for directing water in a first direction diametrically opposite an elongate discharge plenum having a second plenum in fluid flow communication therewith for discharging the water into the pool through a sidewall thereof. The apparatus is placed inside the wall on the side of the pool and produces a smooth even sheet of water which is directed away from the side of the pool. The metering rods are constructed for adjusting pressure along the axial length thereof to cause the water pressure inside of the unit to be maintained evenly across its length thereby directing the water out through the throat of the discharge plenum.

23 Claims, 4 Drawing Sheets

WATER STEAM APPARATUS

This is a continuation of pending application Ser. No. 07/977,089 filed on Nov. 16, 1992.

BACKGROUND OF THE INVENTION

This invention relates to apparatus for swimming pools, spas and the like, and more particularly to an apparatus and method for producing an esthetically pleasing water stream or flow in such a pool or spa.

In order to add an esthetically pleasing flow of water to a pool or spa it has been necessary to construct a waterfall at the edge of the pool. The water is typically drawn out of the pool and passed over a weir at the edge of the pool, or water is drawn out of the pool and fills a vessel where a series of baffles and ribs smoothes and directs the water before it exits the unit.

The current prior art methods, while esthetically pleasing, have drawbacks. First, water which is drawn out of a pool and spills over a weir at the edge of a pool does not have enough forward movement to esthetically move the water away from the side of the pool. Secondly, the construction of this type of waterfall is very expensive since it requires extra gunite-forming and tile finishing.

The container method is also esthetically pleasing but relies on a rising water principle to achieve a smooth and even flow of water. It is expensive to make and it is expensive to install because it does not lend itself to installation at the time when a pool or spa is being gunite-formed.

It is the object of this invention to provide not only a low cost unit for producing a smooth sheet of water at the edge of a pool, but also a unit that can be easily embedded into the gunite at the time of gunite-forming.

SUMMARY OF THE INVENTION

The foregoing and other objects of the invention are accomplished by providing a waterfall producing unit formed with a reservoir of cylindrical construction configured and constructed for placement adjacent a pool edge during construction. First and second metering rods are insertable into the reservoir on the axis thereof from the opposite ends. Each of the metering rods is generally identical and formed as a tubular member with a plurality of water discharge orifices and a closed end with water entering the open end thereof. Each metering rod is further provided with slots therein, each configured for individually receiving a half-moon shaped disc member, the size thereof and the insertion depth thereof being such to promote equalization of water pressure along the axial length of the metering rod. A unitary metering rod may likewise be used.

The reservoir communicates with a discharge path which includes a discharge plenum having an elongate first throat plenum portion of generally rectangular configuration for attachment to the reservoir about an elongate slot formed therein, with the direction of flow through the first plenum portion being in the radial direction relative to the reservoir, and the direction of discharge of the water from the metering rods being in a direction diametrically opposite to the radial direction of the first plenum. A second discharge plenum portion is coupled in fluid flow relation with the first plenum for directing the flow of water in a stream into a side of the pool, the second plenum portion being of an elongate rectangular configuration similar to the dimensions of the first with the length of both plenums approximating the axial length of the reservoir.

The present invention is for a unit that produces a water-fall at the edge of a swimming pool, spa or pond. The unit is placed in the side of the pool and is completely encapsulated by the gunite with a capability of producing a smooth sheet of water which is directed away from the side of the pool. The unit has a generally cylindrically configured reservoir as its lower portion with a discharge path directed upwardly and outwardly towards the interior of the pool with a small portion of the second plenum portion extending slightly past the interior edge of the pool.

The reservoir portion is located under the throat portion and water is introduced into the reservoir portion via metering rods at each end of the reservoir portion. Water flows through the metering rods and is forced into the reservoir portion where it is then forced upward and outward then discharged into the pool through the throat portion. The metering rods extend into the reservoir portion between the left side and the right side for a majority of the length of the reservoir portion, and include pressure adjustment slots and gates to produce an even water pressure across the reservoir and throat portions which result in a smooth even flow of water from the side of the pool, spa or pond.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figure 1:
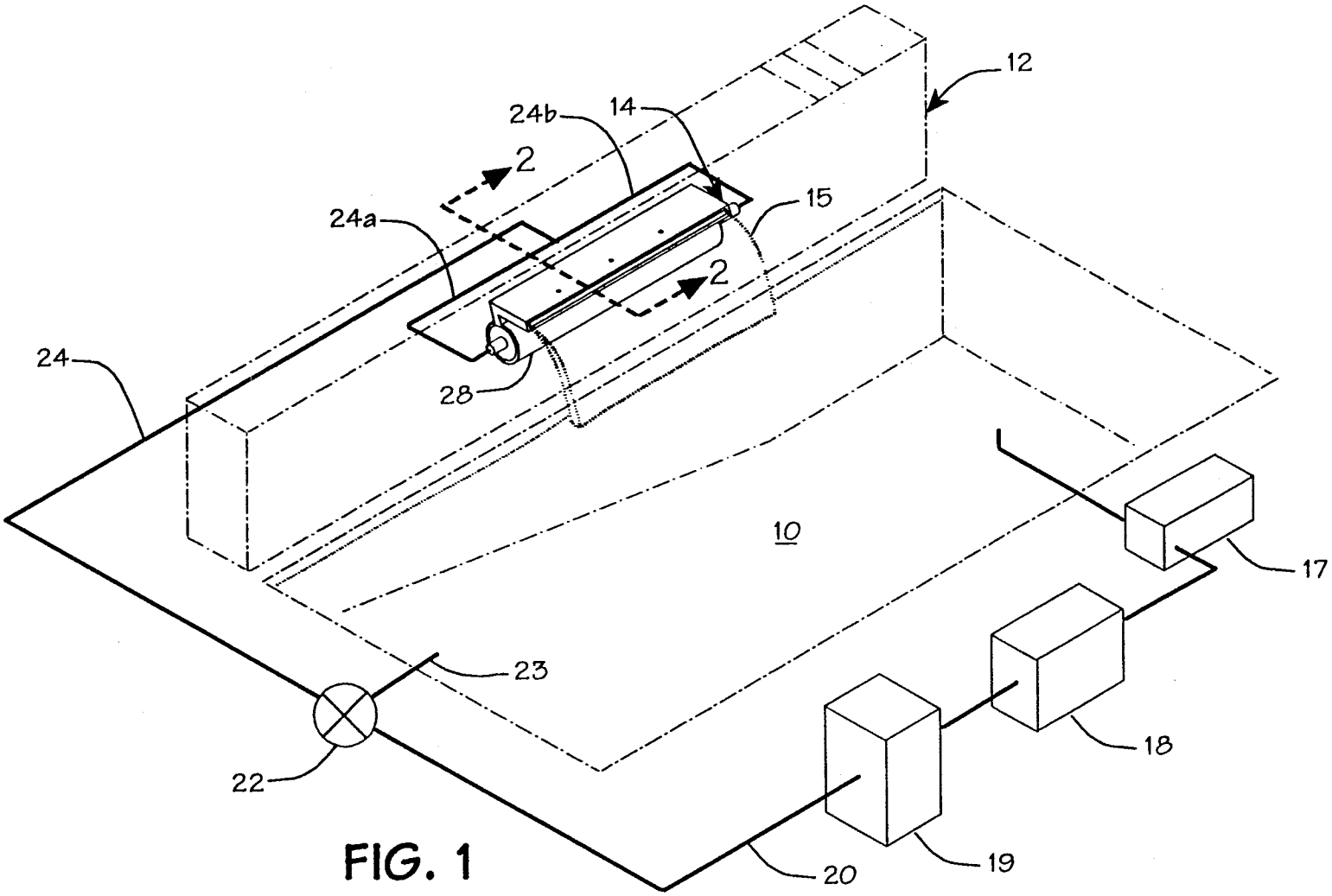
FIG. 1 is a perspective diagrammatic view of a swimming pool utilizing the water stream apparatus in accordance with the invention.

Referring now to the drawings, and particularly to FIG. 1, there is shown a swimming pool construction, generally designated 10, with the pool itself shown in broken lines, along with a sidewall construction, generally designated 12, which houses the water stream apparatus, generally designated 14, which produces a waterfall, generally designated 15, as part of the water recirculation system. The water recirculation system includes a pump 17, withdrawing fluid from the pool 10, and passing the water through a filter 18 and a heater 19, after which it passes through a pipe 20, from which it is returned to the pool.

The return to the pool is accomplished by use of a pool return valve 22, which provides a first discharge outlet 23 directly to the pool, and a second return path via pipe 24 through the water stream apparatus 14. The pipe 24 includes first and second portions **24*a* and 24*b*** entering into the apparatus 14 at opposite ends of the reservoir 28, thereof.

Figure 2:
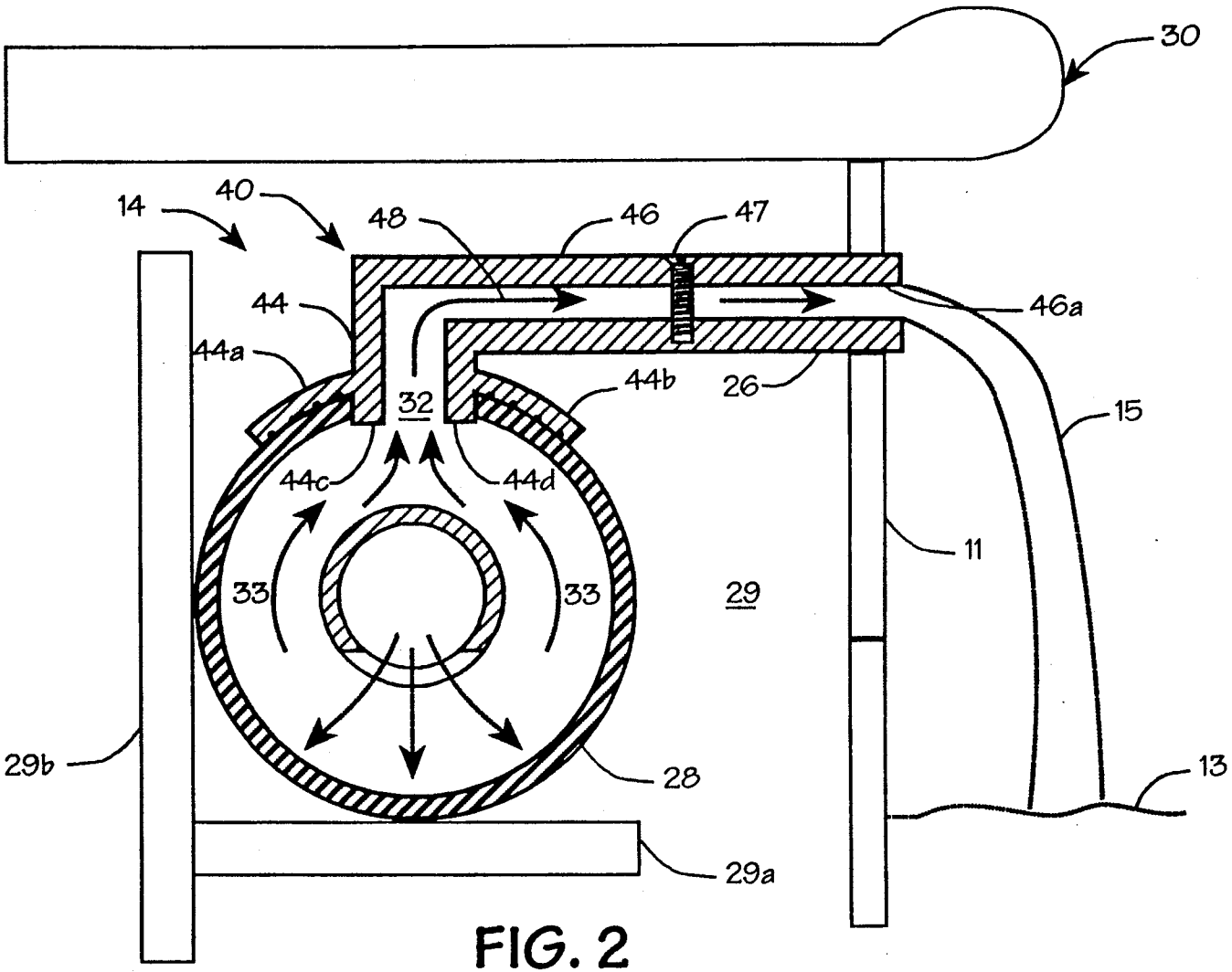
FIG. 2 is a cross-sectional view of the water stream apparatus of FIG. 1, as viewed generally along line 2—2 thereof.

Referring also to FIG. 2, the apparatus 14 is constructed at the same time as the pool 10, and is shown within an enclosure portion 29 formed of gunite, adjacent a vertical sidewall 11 of the pool 10 where a smooth waterfall 15 is shown exiting from the gunite sidewall 11 into the pool water surface 13. The enclosure 29 includes the vertical pool sidewall 11, as well as a horizontal support surface 29*a* and a rear vertical support surface 29*b*, and, at the upper surface by a deck or horizontal pool coping 30.

The apparatus 14 includes the cylindrical reservoir 28, which may be formed of any suitable material such as stainless steel or other non-corrosive metal, or alternatively and preferably, of a plastic material, such as ABS or PVC plastic. The cylindrical reservoir 28 is basically a tubular member with first and second ends 28*a*, 28*b* (FIG. 3) and an axially extending elongate slot 32 formed in a surface thereof and extending substantially the length thereof. As shown in FIG. 2, the reservoir is oriented with the slot at the upper end thereof, that is, upwardly vertically disposed.

A discharge plenum assembly 40 is attached within the slot 32, as will be described. The plenum assembly 40 includes a first plenum portion 44, and a second transversely extending plenum portion 46, which are configured to form therein a discharge path 48 from the reservoir 28 through the sidewall 11 of the pool 10. For interconnection purposes, the first plenum portion 44 includes integrally formed arcuately configured outwardly extending flange portions 44*a* and 44*b*, formed on a radius equal to the radius of the outer surface of the reservoir 28.

Integrally formed with each flange portion 44*a* and 44*b*, respectively, is a lip portion 44*c* and 44*d*, respectively, which are downwardly (as viewed in the drawings) oriented and dimensioned, configured and arranged for close fitting relationship within the elongate slot 32 with the flanges 44*a* and 44*b* in close abutting relation with the outer surface of the reservoir 28, the plenum assembly 40 then being suitably secured to the reservoir 28, such as by an adhesive.

Figures 3, 4:
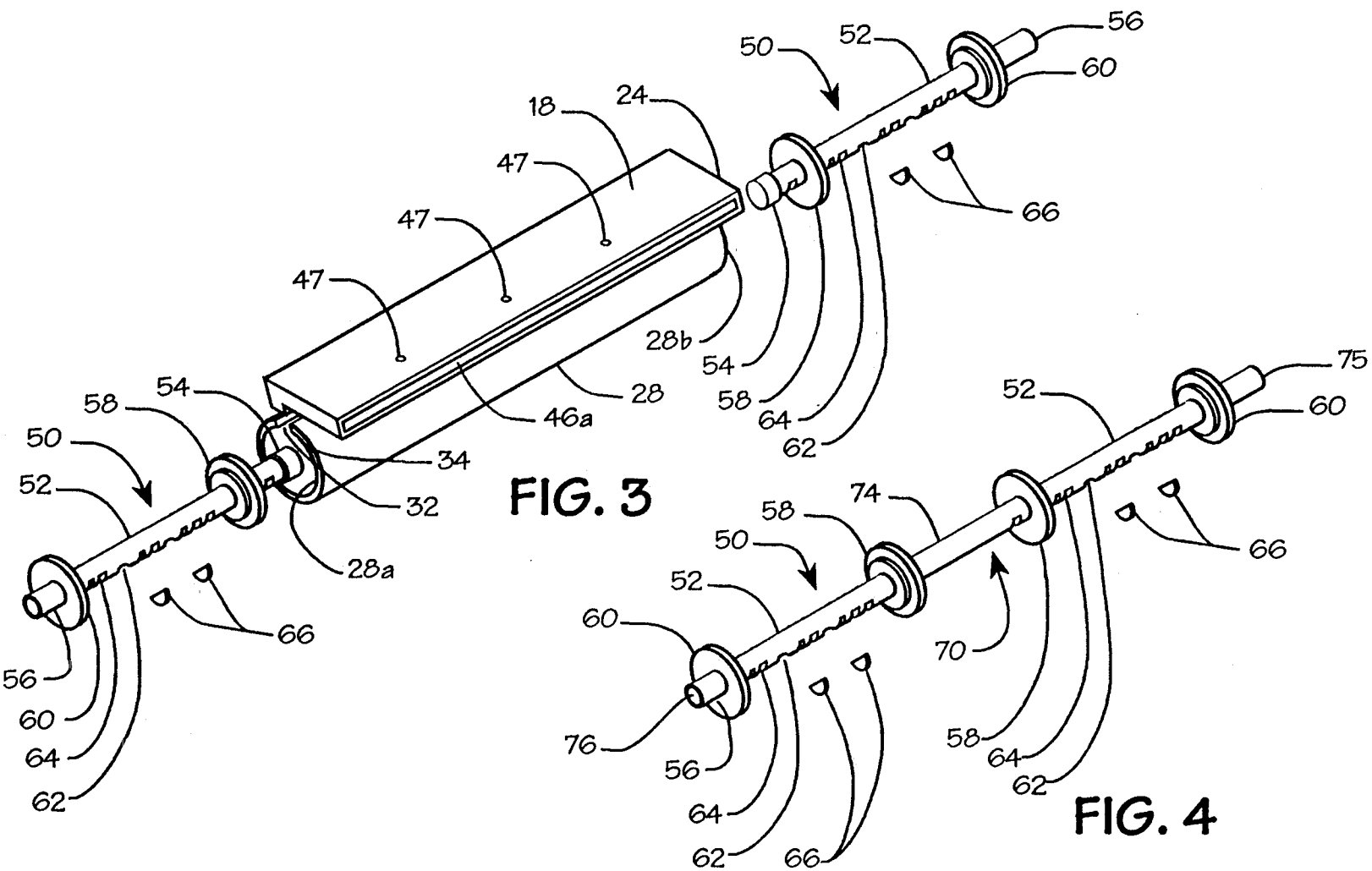
FIG. 3 is an exploded perspective view of the water stream apparatus of FIG. 2, showing separable metering rods.
FIG. 4 is a perspective view of an alternate embodiment of a unitary metering rod for use in the apparatus of FIGS. 2 and 3.

The plenum assembly 40 may conveniently be formed as two parts, adhesively bonded together with screw members 47 holding the plenum portion 46 halves together with proper spacing for the dimension of the internal fluid flow path therein. As shown in FIG. 3, there are three screws 47 which may be used to set and maintain the vertical dimension of the opening 46*a* of the plenum portion 46.

The plenum assembly 40 has a water flow path 48 which is radially upwards with plenum portion 44 and is directed at a generally perpendicular angle through plenum portion 46 with the direction of flow of the last mentioned portion being in a plane generally parallel to the surface 13 of the pool water. The terminal edges of the elongate opening 46*a* of the plenum portion 46 are generally smooth to provide a weir effect for producing the waterfall 15 as a smooth flowing sheet of water.

Figure 5:
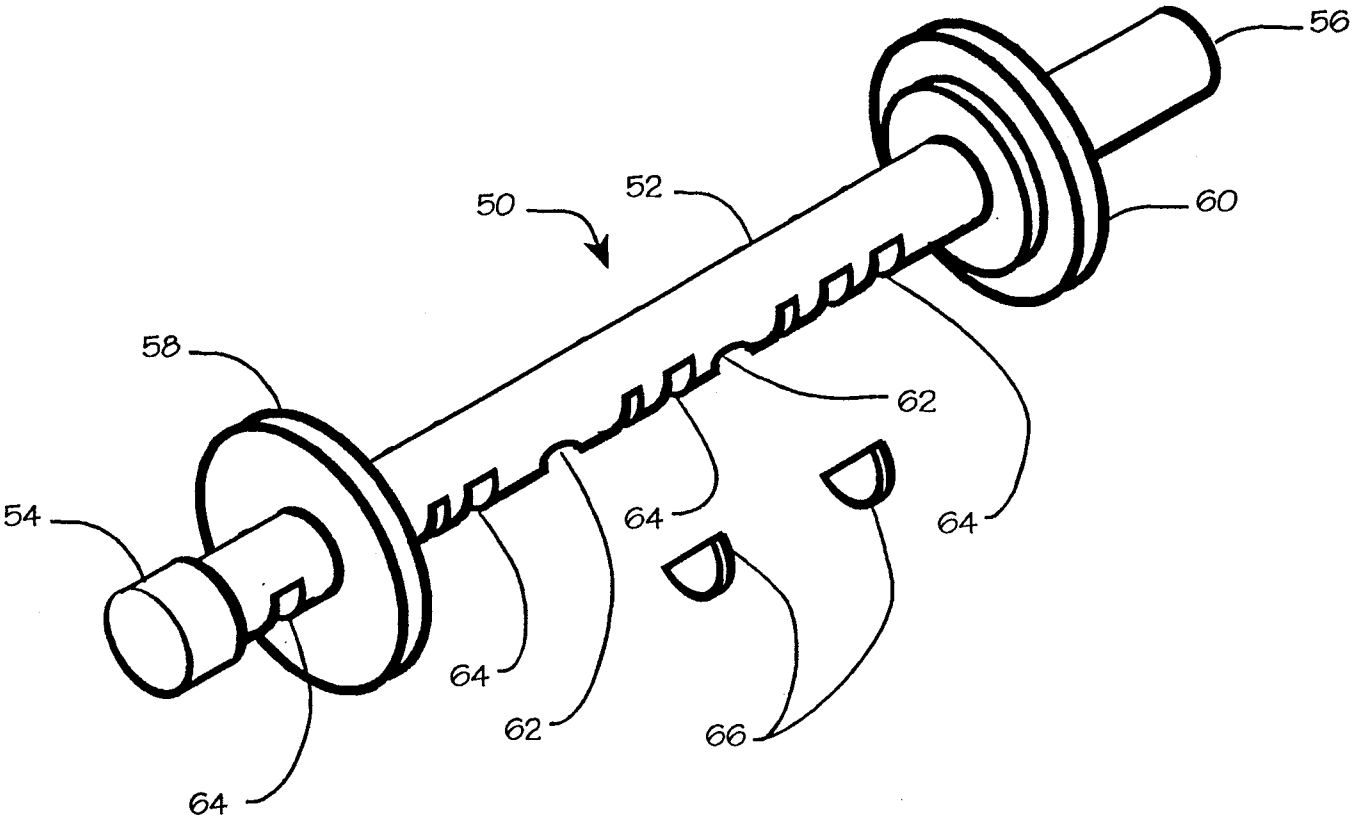
FIG. 5 is an enlarged perspective view of one of the metering rods used in the apparatus of FIG. 2.

Referring also to FIGS. 3 through 5, the water stream apparatus 14, as described has a reservoir 28 which has open ends 28*a* and 28*b*. In FIG. 3, there are shown two manifold discharge pipes or metering rod assemblies, generally designated 50, the assemblies 50 including a tubular member 52 capped or closed at one end by a cap 54 and open at the other end 56.

Intermediate the two ends are first and second washer shaped-disc members 58 and 60, the disc 58 being proximate the cap 54 and the disc 60 being proximate the open end 56. The diameters of the two discs 58 and 60 are generally identical and dimensioned for being received within the interior of the reservoir 28 by insertion through the open ends 28*a* and 28*b* thereof.

The length of the tubular member 52 of the metering rod assemblies 50 from the disc 60 to the cap 54 is about one-half or less of the length of the reservoir 28 (when two metering rods are used) so that upon insertion of the two assemblies into the interior of the reservoir 28, the outer discs 60 serve as end caps or closures for the reservoir 28, when suitably adhesively bonded to the reservoir 28. By utilization of two metering rod assemblies 50, the end caps 54 closing the inner ends of the metering rod tubes 52 allows the function of the nozzles, formed by orifices 62 and slots 64, to dominate the flow characteristics of both metering rod tubes 52.

The discs 60 may alternatively be formed with a larger diameter approximating the outer diameter of the reservoir 28 for abutting relation with the ends thereof. In either instance, the objective is to seal the ends of the reservoir by use of the discs 60, as well as seal the washer openings of the discs 60 to the tubular member 50.

As better illustrated in FIG. 5, the tubular member 52 is provided with nozzle means in the form of generally circularly configured water discharge orifices 62 and generally rectangular slots 64, there being two orifices 62 equally spaced between disc 58 and 60, and a plurality (eight being indicated) of slots 64, the orifices and slots having the centers thereof on a common line parallel to the axial centerline of the tubular member 52.

The orifices 62 and the rectangular slots 64 act as water discharge nozzles along the length of the tubular member 52 into the interior of the reservoir 28. For enabling the equalization of water pressure along the length of each of the metering rod assemblies 50, adjustable gate valve members 66 are provided, the shape thereof being of a half-disc or half moon configuration with a thickness generally equal to the width of the rectangular slots 64. For adjustment of the pressure, one or more valve members 66 are inserted into one or more selected slots 64 along the length of the tubular member 52 for partially blocking the interior thereof, with the number of valves thus formed and the depth of insertion varying as required for lengthwise pressure equalization.

After placement and securing of the required number of valve members 66 as described, the rod assemblies 50 are inserted into the interior of the reservoir 28 with the aligned openings (orifices 62 and slots 64) facing downwardly, that is, diametrically opposite the discharge slot 32 of the plenum portion 44. In this manner, the aligned water emitting openings are placed perpendicular to the flow of water through tubular member 52 and facing generally downward with their discharge towards the bottom of the reservoir portion 28.

FIG. 4 shows an alternative embodiment of the metering rod assembly, which is a one-piece tubular assembly 70, the primary difference being that the two tubular members 52 have been merged into one tubular member 74 with two open ends 75 and 76, the discs 58 and 60 are identical to those previously described. Similarly, the orifices 62 and slots 64 are generally identically configured, dimensioned and arranged relative to the length of the reservoir 28.

As indicated in FIG. 3, the hollow round interior surface of reservoir 28 has the slot 32 running down its entire length, the opening 34 of slot 32 allowing an upwardly and outwardly direction of water flow through the interior path provided by the plenums 44 and 46 to the side of the swimming pool 11 to form the waterfall 15 down to the water surface 13. With a dual water inlet located at the left and right side of the reservoir 28, the specific flow of water is indicated by arrows 33 (FIG. 2).

It can be seen that water flows into metering rod assemblies 50 (or a single metering rod assembly 70, as shown in FIG. 4) which provides an even amount of water pressure across the entire reservoir and slot 32 by means of adjustable gate valves provided by valve members 66 coacting with slots 64, with water discharge from the orifices 62 and slots 64 downwardly, and about the interior surface of the reservoir upwardly to be discharged through the plenums 44 and 46. The entire unit 14 is plumbed and placed in a pre-formed compartment 29 below the pool coping 30 and inside the pool wall 11. Prior to gunite-forming a small portion of the open terminal end 46*a* of plenum 46 will be allowed to protrude beyond the pool wall 11 so that only a small portion of the discharge plenum slot opening 46*a* is seen after the entire pool has been gunite-formed.

In accordance with the invention, the time and labor of installing the unit 14 is considerably less than forming a separate pool area where water would flow over an edge and is easier to fabricate and less costly to install than a large steel tank that has to be mounted and plumbed after the gunite is cured.

The unit 14 is designed to be a one-step installation operation. It is completely plumbed and set into place within compartment 29 at the same time all the other plumbing is installed and does not require the plumber to return a second time to complete the pool or spa installation. The unit 14 allows the gunite to be formed over and around the entire unit so that it becomes an integral part of the pool and its plumbing.

The components of the assembly 14 may be constructed entirely of PVC or ABS pipe material. The plenums 44, 46 can be fabricated from PVC or ABS, or can be extruded from the same PVC or ABS material reservoir 28.

In operation, the water flowing into the metering rod assemblies 50 (or 70) from the left side and the right side is equalized along its length by restricting the flow of water. By metering the water pressure exiting each nozzle means, such as orifices 62 and slots 64, by means of adjustable gate valves formed by valve members 66 inserted within pre-selected slots 64, an even pressure can be maintained throughout the entire length of the reservoir 28 and through the openings of plenums 44 and 46, giving a smooth even sheet of water exiting as a waterfall 15 through elongate weir opening 46*a*.

The gate valves formed by valve members 66 within slots 64 can be made to vary the pressure by increasing or decreasing the depth of penetration into the slots 64 of the metering rod tubes 52. Stationary inner spacers 58 act as compartment gates for the flow of water from opposite ends of the tubes and subdue some of the turbulence while also aiding in the balance of water pressure across the length of the reservoir 28 of the entire unit 14.

The stationary compartment gates are fabricated so as to allow the metering rod tubes 52 to pass through the interior portions for affixation at the appropriate positions within the reservoir 28, thus giving a variable pressure to each compartment formed by the left and right discs 58. The end caps 54 closing the inner ends of the metering rod tubes 52 allow the function of the nozzles, formed by orifices 62 and slots 64, to dominate the flow characteristics of both metering rod tubes 52. The sides of the plenums 44 and 46 are generally coplanar with the ends of the reservoir 28 and confine the flow of water to a straight forward movement.

The entire unit 14 embodied herein is preferably completely fabricated from PVC or ABS material. In contrast to the prior art, the weir approach uses only a falling water principle to achieve a waterfall.

While there has been shown and described a preferred embodiment, it is to be understood that various other adaptations and modifications may be made within the spirit and scope of the invention.

What is claimed is:

1. Apparatus for producing a waterfall at a side of a swimming pool and being capable of producing a smooth sheet of water which is directed away from the side of the pool, said apparatus comprising:

elongate reservoir means adapted to be encapsulated by gunite in the side of said pool for receiving water, said reservoir means including an elongate slotted opening;

water flow means having at least one tubular member axially positioned along the axis of and within said reservoir means for flowing water to said reservoir means;

means for coupling an external source of water to said water flow means;

nozzle means in said tubular member formed on a line generally opposite said slotted opening for providing communication between said tubular member and said reservoir means;

valve means at least partially formed within said tubular member for enabling equalization of water pressure along the length of said tubular member with water provided to said coupling means to provide a generally uniform water pressure along the length of said slotted opening; and means for directing water from said reservoir means through said slotted opening to the side of said pool.

2. The apparatus according to claim 1 wherein said water directing means includes plenum means for directing the water from said slotted opening to the side of the pool.

3. The apparatus according to claim 1 wherein said reservoir means is configured for positioning said slotted opening upwardly and said nozzle means downwardly.

4. The apparatus according to claim 1 wherein said reservoir means has an inner cylindrically configured surface and said tubular member is positioned axially with respect to the inner surface.

5. The water flow means according to claim 4 wherein said water flow means includes a second tubular member coaxially aligned with said one tubular member.

6. The apparatus according to claim 5 wherein each of said tubular members has a closed end and an open end, said open ends being configured for receiving water through said coupling means.

7. The apparatus according to claim 6 wherein said closed ends are generally adjacent one another within the central portion of said reservoir means and said open ends are at opposite ends of said reservoir means.

8. The apparatus according to claim 6 wherein said valve means include at least one slotted opening in said tubular member and a member configured for insertion through said tubular member slotted opening into the interior of said tubular member for providing partial blockage of water flow through said tubular member at said location.

9. The apparatus according to claim 8 wherein there are a plurality of said slotted openings in said tubular member and said nozzle means includes at least one of said slotted openings in said tubular member.

10. The apparatus according to claim 8 wherein said nozzle means includes circularly configured orifices.

11. Apparatus for producing a waterfall at a side of a swimming pool said pool including a water circulating system, said apparatus comprising:

a generally cylindrical reservoir adapted to be connected in the water circulation system of said pool, said reservoir having an elongate slot formed in a sidewall thereof;

at least one water discharge metering rod positioned on the axial centerline of said reservoir;

nozzle means formed in said rod configured, dimensioned and arranged for directing water in a direction diametrically opposite said elongate slot;

valve means in said rod for enabling adjustment of the pressure of said nozzle means: and means for directing water from said reservoir through said elongate slot to the side of said pool.

12. The apparatus according to claim 11 wherein said nozzle means includes a plurality of apertures formed on a line generally opposite said elongate slot.

13. The apparatus according to claim 12 wherein said plurality of apertures include a combination of slots and circularly configured orifices.

14. The apparatus according claim 13 wherein said valve means includes water flow blockage means insertable into at least one of said slots in said metering rod.

15. The apparatus according to claim 13 wherein said valve means include a half moon shaped member insertable into one of said slots of said nozzle means.

16. The apparatus according to claim 11 wherein said apparatus includes a second water discharge metering rod generally identically configured to said one water discharge metering rod and coaxially positioned on the axial centerline of said reservoir.

17. The apparatus according to claim 16 wherein each of said metering rods includes an open end and a closed end, the closed ends thereof being in proximate relation within said reservoir.

18. The apparatus according to claim 17 wherein said apparatus includes means for providing water flow from the water circulation system to the open end of each of said metering rods.

19. The apparatus according to claim 11 wherein said valve means includes means for enabling the equalization of water pressure along the length thereof.

20. The apparatus according to claim 11 wherein said means for directing water from said reservoir to a side of said pool includes a discharge plenum having an elongate opening for passage of water therefrom into said pool.

21. The apparatus according to claim 20 wherein said plenum has one end in fluid flow communication with the elongate slot of said reservoir.

22. The apparatus according to claim 21 wherein said plenum has a first portion radially directed relative to said reservoir, and a second portion generally transverse to said first portion.

23. The apparatus according to claim 20 wherein said elongate opening of said plenum is provided with means for setting and maintaining at least one dimension thereof.

* * * * *